United States Patent [19]

Yamazaki et al.

[11] Patent Number: 5,042,382

[45] Date of Patent: Aug. 27, 1991

[54] STAMP MECHANISM FOR MATRIX PRINTER

[75] Inventors: Ryuji Yamazaki, Isehara; Kazunori Matsumoto, Fujisawa; Katsuyoshi Yokota, Kamakura, all of Japan

[73] Assignee: NCR Corporation, Dayton, Ohio

[21] Appl. No.: 385,332

[22] Filed: Jul. 24, 1989

[30] Foreign Application Priority Data

Sep. 16, 1988 [JP] Japan ..... 63-230155

[51] Int. Cl.[5] ..... B41K 1/42

[52] U.S. Cl. ..... 101/379; 101/333

[58] Field of Search ..... 101/405, 406, 93, 333, 101/371, 379, 41, 44

[56] References Cited

U.S. PATENT DOCUMENTS 806,111 12/1905 DeCoppet ..... 101/110

2,541,800 2/1951 Whittaker ..... 101/406

2,887,043 5/1959 Terry ..... 101/93

*Primary Examiner*—Edgar S. Burr

*Assistant Examiner*—Joseph R. Keating

*Attorney, Agent, or Firm*—Wilbert Hawk, Jr.; Albert L. Sessler, Jr.; George J. Muckenthaler

[57] ABSTRACT

A stamp mechanism for printing a message on a receipt or like record media issued from a business machine. The stamp mechanism includes a stud with a spring-loaded washer thereon. The stud extends through an opening in a stamp holder and supports a spherically-shaped skirt that mates with a recess in the stamp holder. The washer includes downwardly extending tongues that engage with slots in the stamp holder and which arrangement maintains the stamp in a parallel position relative to the platen.

12 Claims, 8 Drawing Sheets

76
108
78
104
80
74
86
90
88
100
72
102
106

STAMP MECHANISM FOR MATRIX PRINTER

BACKGROUND OF THE INVENTION

In the field of printing, the most common type printer has been the printer which impacts against record media that is caused to be moved past a printing line or line of printing. As is well-known, the impact printing operation depends upon the movement of impact members, such as print hammers or wires or the like, which are typically moved by means of an electromechanical drive system and which system enables precise control of the impact members.

In the field of dot matrix printers, it has been quite common to provide a print head which has included therein a plurality of print wire actuators or solenoids arranged or grouped in a manner to drive the respective print wires a very short, precise distance from a rest or non-printing position to an impact or printing position. The print wires are generally either secured to or engaged by the solenoid plunger or armature which is caused to be moved such precise distance when the solenoid coil is energized and wherein the plunger or armature normally operates against the action of a return spring.

It has also been quite common to provide an arrangement or grouping of such solenoids in a circular configuration to take advantage of reduced space available in the manner of locating the print wires in that specific area between the solenoids and the front tip of the print head adjacent the record media. In this respect, the actuating ends of the print wires are positioned in accordance with the circular arrangement and the operating or working ends of the print wires are closely spaced in vertically-aligned manner adjacent the record media. The availability of narrow or compact actuators permits a narrower or smaller print head to be used and thereby reduces the width of the printer because of the reduced clearance at the ends of the print line. The print head can also be made shorter because the narrow actuators can be placed in side-by-side manner closer to the record media for a given amount of wire curvature.

In the wire matrix printer which is utilized for receipt and for journal printing operations, the print head structure may be a multiple element type and may be horizontally disposed with the wire elements aligned in a vertical line and supported on a print head carriage which is caused to be moved or driven in a horizontal direction for printing in line manner across the receipt or journal paper and wherein the drive elements or transducers may be positioned in a circular configuration with the respective wires leading to the front tip of the print head. In the wire matrix printer which is utilized for business forms or like record media printing operation, the print head may be oriented in a manner wherein the nose is pointed downward for printing on the form, slip or like record media while the carriage and print head are moved above and across the form or like record media in the horizontal direction.

Further, in the wire matrix printer which is utilized for receipt, slip and journal printing operations, the individual print heads may be vertically oriented and printing performed by means of the print wires moving downwardly to impact on the record media. Alternatively, the individual print heads may be horizontally oriented and printing performed by means of the print wires moving horizontally to impact on the record media. A preferred number of four of such individual print heads is common in known arrangements.

The dot matrix printer is commonly used in an electronic cash register (ECR) or in a point of sale (POS) terminal. A stamp device also is commonly used in dot matrix printing and may comprise ink impregnated material such as porous rubber contained in a holder. The holder may be coupled to a solenoid or like actuator to press the stamp device against record media suitably placed against a platen or like supporting member or stand.

In such conventional stamping devices, the face of the stamp may not always be straight or square with the surface of the supporting member and which may result in uneven printing. The conventional stamping device may be constructed in a manner such that the angle of the stamping face varies to conform to the slope of the supporting member during the course of the printing operation.

Representative documentation in the field of stamp apparatus includes U.S. Pat. No. 806,111, issued to F. DeCoppet on Dec. 5, 1905, which discloses a stamping device having spaced conical collars with one collar traversed by one end of a spiral spring.

U.S. Pat. No. 2,541,800, issued to J. E. Whittaker on Feb. 13, 1951, discloses a shiftable stamp holder wherein a swivel head which carries a marking stamp will adjust itself automatically to suit the angle. The head is formed with a semi-spherical cavity and a compression spring presses against a washer on a shank of the holder.

U.S. Pat. No. 2,887,043, issued to P. V. Terry on May 19, 1959, discloses a self-aligned platen which uses a ball and socket to automatically position the platen to uniformly press a tape against selected printed characters.

SUMMARY OF THE INVENTION

The present invention relates to a dot matrix printer for impact printing on record media. The dot matrix printer includes two separate printing stations, one station positioned near the front of the printer and the other station positioned rearwardly of the one station. The two stations are arranged in tandem manner and the two separate print head carriages are coupled to a drum cam type drive mechanism positioned between the two carriages. The two carriages along with the associated print heads are driven by the drum cam type drive mechanism in equal and opposite directions during printing operations.

The one station near the front of the printer is utilized for dot matrix printing on a receipt and on a slip or like business form and is referred to as the receipt/slip station. The other station rearwardly of the one station is utilized for dot matrix printing on a journal and is referred to as the journal station. A plurality of solenoid driven, single wire print heads are supported in spaced relationship on each carriage for performing the printing operations at the two printing stations.

A stamp mechanism or electro-stamp apparatus is provided for use at the receipt/slip station to print a fixed message or logo on the receipt. The stamp mechanism includes a stamp holder that is supported at one end of a stud which is fixed to a plunger of a stamp driving device. The stamp holder is pressed by means of a spring against a skirt portion of a guide member which acts as a bearing for the stamp mechanism. A washer-type member is biased by the spring against a surface of the stamp holder and includes a pair of tongue members that engage the stamp to maintain the holder in precise position for the stamping operations.

In accordance with the present invention, there is provided a stamp mechanism in a printer having a stamping surface, the stamp mechanism comprising a stamp, a holder for holding the stamp, drive means for moving the stamp holder from a nonstamping position to a stamping position, the stamp holder having an aperture therethrough and defining a sloping wall in the aperture, a stud member coupled to the drive means and including a skirt portion having a curvature equal to and mating with the sloping wall of the stamp holder, the stud member extending through the aperture, a washer-like member having a pair of tongues integral therewith and engaging with said stamp holder, and resilient means for biasing the stamp holder against the skirt portion for slidably holding the stamp holder on said stud member.

In view of the above discussion, a principal object of the present invention is to provide an improved stamping mechanism in a dot matrix printer.

Another object of the present invention is to provide a stamping mechanism which is constructed to be easily removable from the dot matrix printer.

An additional object of the present invention is to provide a stamping device that retains a stamping position after an initial operation.

A further object of the present invention is to provide a stamping mechanism wherein the stamp conforms to the surface of a platen or like member and exerts substantially the same pressure over the surface of the stamp onto the surface of the platen.

Additional advantages and features of the present invention will become apparent and fully understood from a reading of the following description taken together with the annexed drawing.

DESCRIPTION OF THE PREFERRED EMBODIMENT

Figure 1:
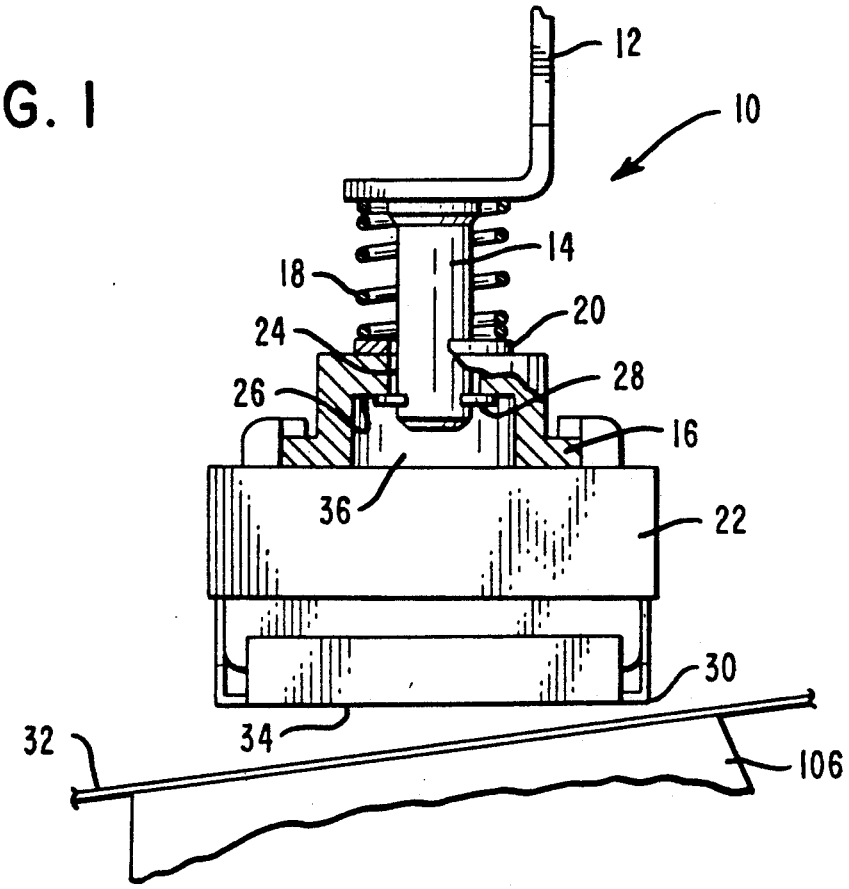
PRIOR ART FIG. 1
FIG. 1 is a view, partially in section, of a conventional stamping device.

Prior to describing the structure of the present invention, it is convenient to disclose a conventional stamping device 10, as shown in FIG. 1. The conventional stamping device 10 has a supporting bracket 12 with a stud 14 and a stamp holder 16. A coil spring 18 encircles the stud 14 and is positioned between the bracket 12 and a washer 20 adjacent the holder 16. A solenoid or other like actuator (not shown) may be secured to the bracket 12 and be operated to move the stud 14 downwardly in operating manner. A stamp 22 is detachably held by the stamp holder 16.

The stud 14 projects through a hole 24 in the stamp holder 16 and is secured or retained against the lower surface 26 of the stamp holder 16 by a clip 28. The diameter of the hole 24 in the holder 16 is larger than the diameter of the stud 14.

The stamp holder 16 is thus supported by means of the clip 28 on the stud 14. When the bracket 12 and the stud 14 are moved downwardly by means of an actuator to perform a stamping operation, the stamp holder moves downwardly and the right hand edge 30 engages first with a receipt or like record media 32. The stud 14 is moved further downward wherein the lower surface 34 is caused to fully engage with the receipt 32. The angle of the stamp holder 16 and of the stamp 22 is changed so that the lower surface 34 is parallel with the receipt 32 for stamping a message thereon. The larger diameter of the hole 24 enables the stud 14 to be movable therein and to permit the stamp holder 16 and the stamp 22 to be angled for the stamping operation.

The stud 14 then moves further in the downward direction and into the opening 36 formed by the stamp holder 16. In the downward position, the spring 18 exerts pressure on the stamp holder 16 and the stamp 22 to print the message on the receipt. Since the stamp holder 16 and the stamp 22 are returned to a home position after each stamping operation by reason of the spring 18 and washer 28 arrangement on the stud 14, the prior art or conventional device allows for uneven stamping or printing on the receipt 32. A difference in pressure on two sides of the spring 18 and a difference in time between contact of the two edges of the lower surface 34 with the receipt 32 may also cause uneven stamping or printing thereon. Further, in the case of a slip printing operation and upon insertion of a slip into the printer, it is necessary to maintain the printing apparatus along with the stamp device in position to print evenly on the slip or like record media.

Figure 2:
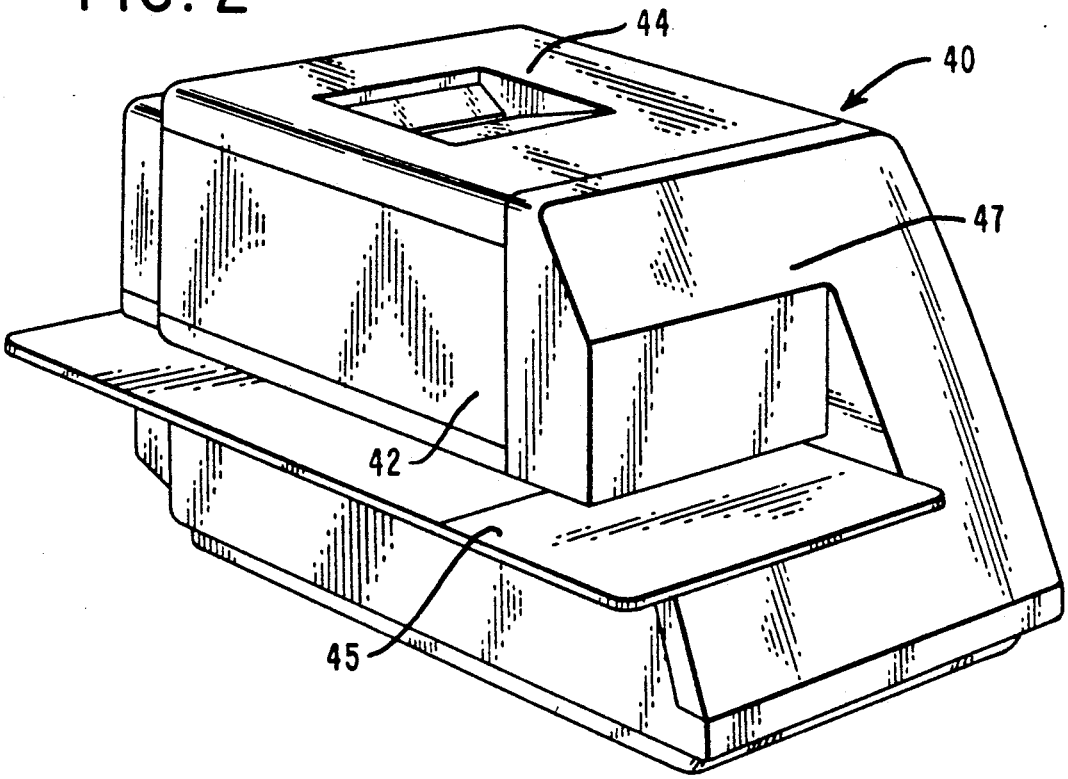
FIG. 2 is a perspective view of a dot matrix printer incorporating the subject matter of the present invention.

Referring now to FIG. 2, a printer 40 is designed as a two station, receipt/slip and journal printer. The receipt/slip printing station occupies a front portion 42 and the journal printing station occupies a rearward portion 44 of the printer 40. A slip table 45 is provided along the left hand side of the printer 40. A front cover 47 swings toward the right to expose certain operating parts of the printer 40.

Figure 3:
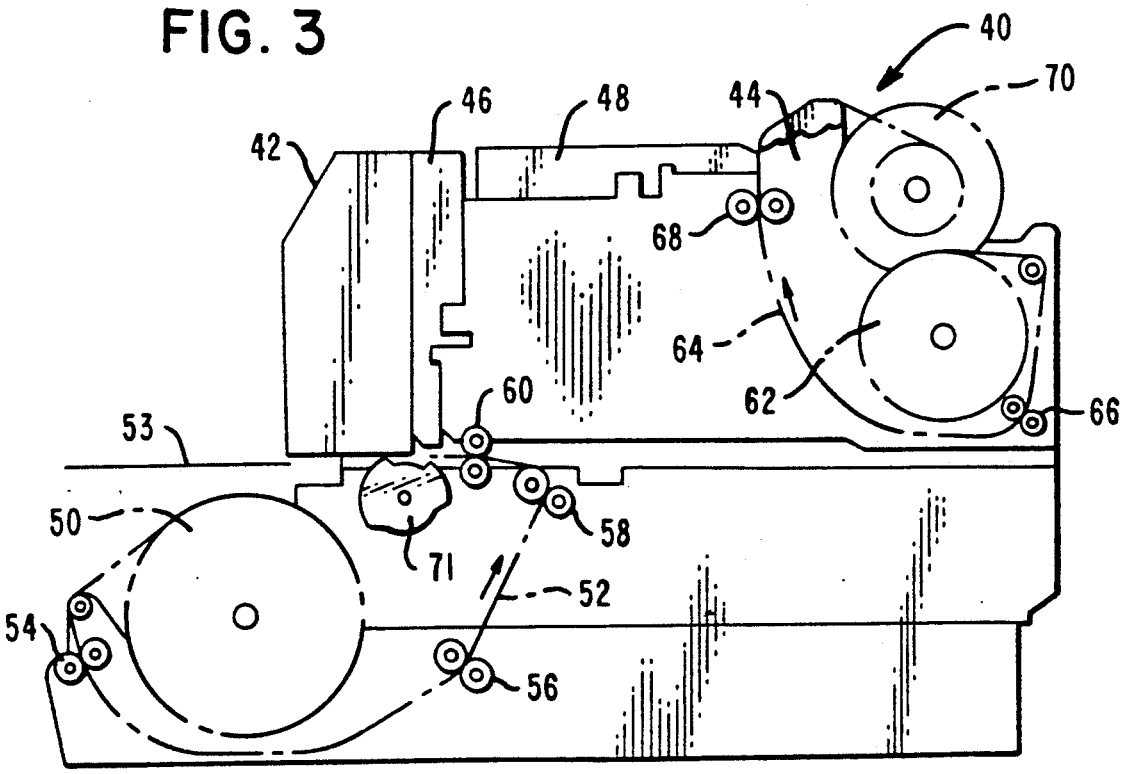
FIG. 3 is a right side elevational view in diagrammatic form showing the arrangement of certain elements of the printer.
Figure 4:
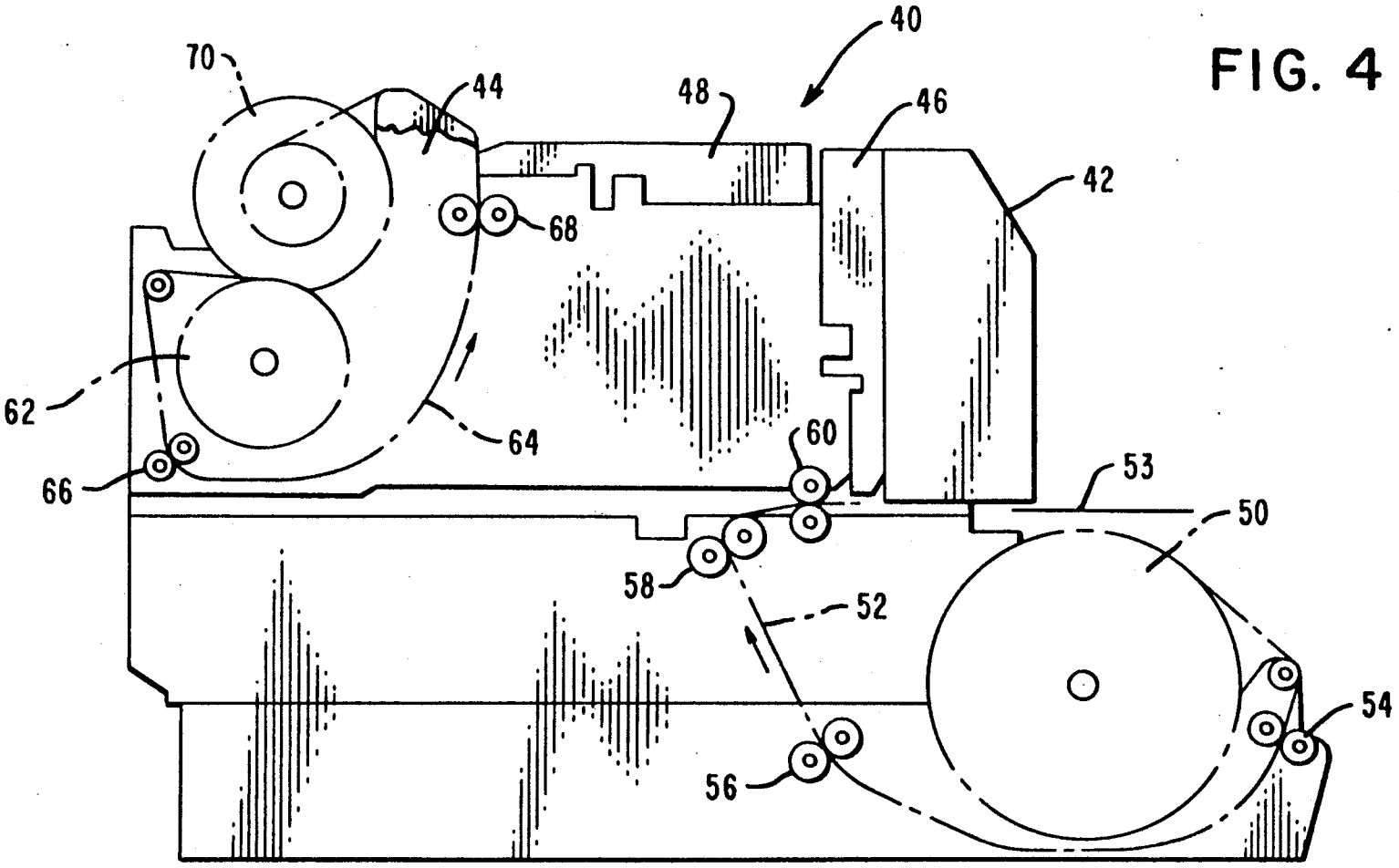
FIG. 4 is a left side elevational view in diagrammatic form showing the arrangement of such certain elements of the printer.

FIGS. 3 and 4 are right and left side elevational views and show certain elements of the printer 40 in diagrammatic form. The receipt/slip portion 42 and the journal portion 44 include individual print wire solenoids (not shown) along with a ribbon cassette 46 for the receipt/slip printing station operation and a ribbon cassette 48 for the journal printing station operation. A roll 50 of receipt paper is journaled at the front of the printer 40 and the receipt paper 52 is driven and guided by appropriate pairs of rollers, as 54, 56, 58 and 60 in a path past the receipt/slip printing station for printing operation and for issuance of a receipt 53 after cutting thereof from the receipt paper 52. A supply roll 62 of journal paper is positioned in a suitable cradle at the rear of the printer 40 and the journal paper 64 is driven and guided by appropriate pairs of rollers, as 66 and 68, in a path from the supply roll 62, past the journal printing station, and onto a take-up roll 70. A timing plate 71 (FIG. 3) is provided at the receipt/slip printing station.

Figure 5:
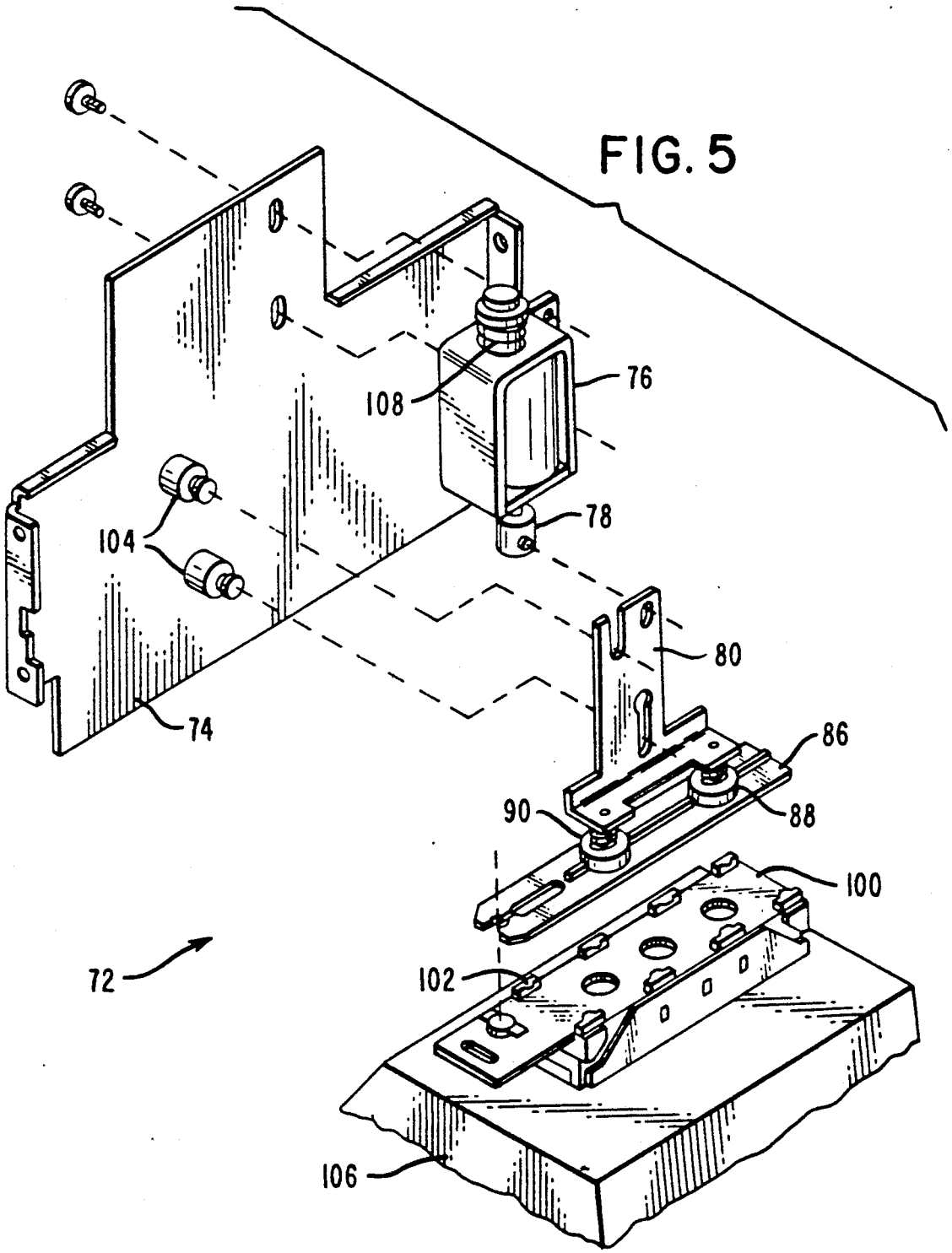
FIG. 5 is an exploded perspective view of the stamping mechanism of the present invention.
Figure 6:
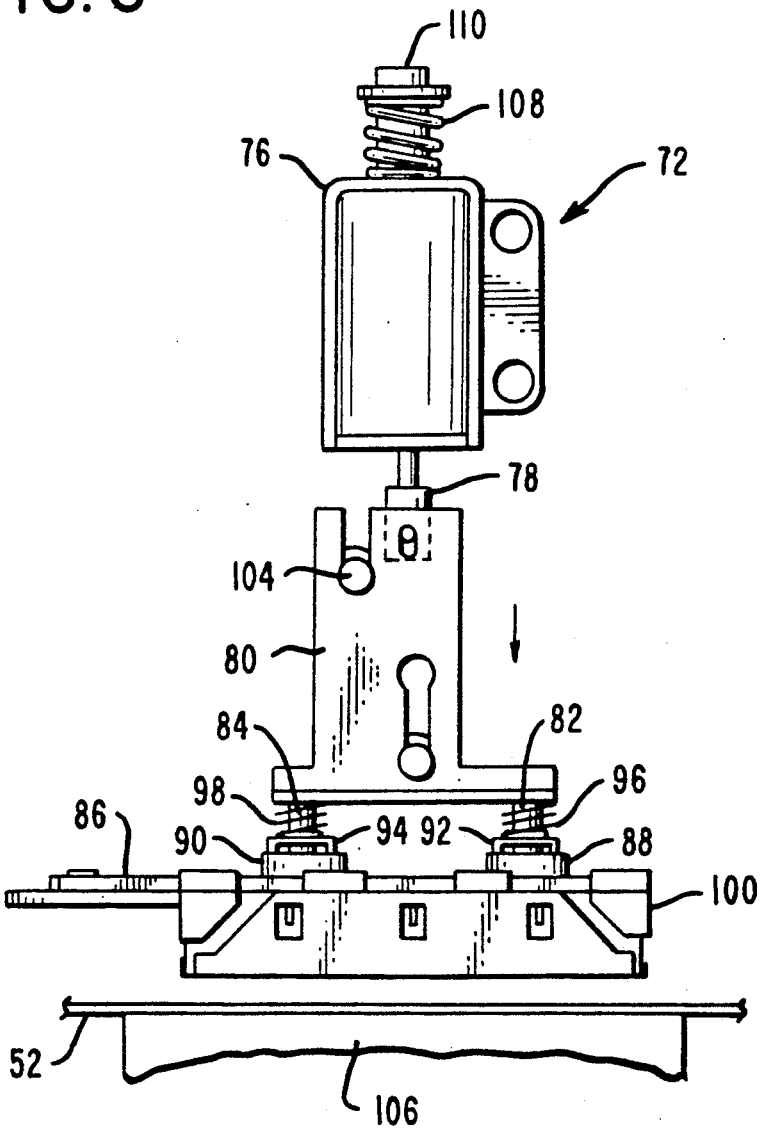
FIG. 6 is a front elevational view of the stamping mechanism shown in FIG. 5.

FIG. 5 is an exploded perspective view and FIG. 6 is a front elevational view of the stamping mechanism of the present invention. The stamping mechanism is generally indicated as 72.

A support plate 74 has secured thereto a solenoid 76 with a plunger 78 connected to an L-shaped arm 80. The stamping mechanism includes a pair of spaced studs 82 and 84 (FIG. 6) which are secured to the arm 80, and a stamp holder 86 which is coupled to the spaced studs 82 and 84. The stamp holder 86, the arm 80, and the studs 82 and 84 are constructed to move in the vertical direction upon actuation of the solenoid 76. The stamp holder 86 includes a pair of cylindrical portions 88 and 90 as an integral part thereof and a pair of washers 92 and 94 are disposed on the portions 88 and 90 and biased by a pair of springs 96 and 98. The springs 96 and 98 are coiled around the respective studs 82 and 84 and provide a pressure force between the lower surface of the L-shaped arm 80 and the washers 92 and 94.

A printing stamp or electro member 100 is removably secured to the stamp holder 86 by means of clips, as 102 (FIG. 5). In one arrangement, the printing stamp 100 may be slidably removed from the stamp holder 86 in the leftward direction, as viewed in FIG. 6. When the solenoid 76 is energized to move the plunger 78 in the downward direction, the L-shaped arm 80 is guided by guide studs 104 (FIG. 5) secured to the support plate 74. The stamp holder 86 and the stamp 100 are moved downwardly and the stamp is pressed against receipt paper 52 for printing a message thereon. The receipt paper 52 is supported on a platen or like member 106 for the printing and stamping operations. A coil spring 108 (FIG. 6) is provided on a stud 110 of the solenoid 76 for use in the deactuated condition of the solenoid.

Figure 7:
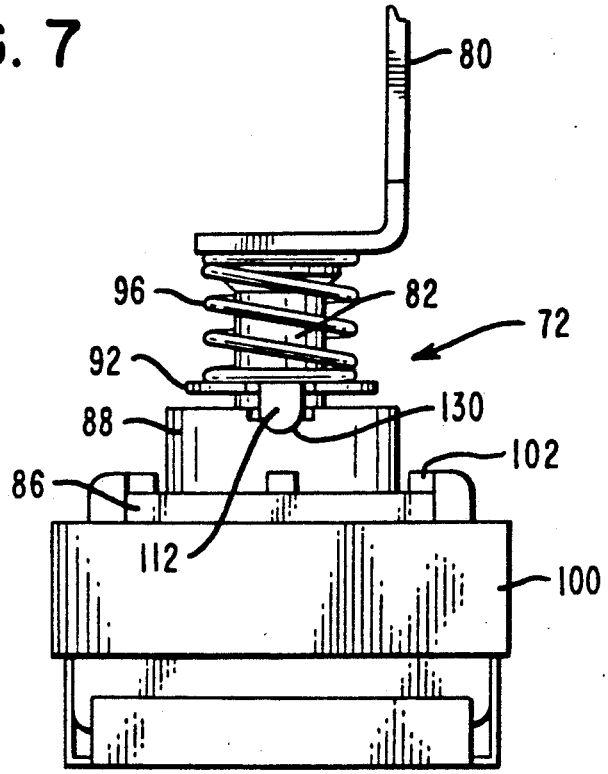
FIG. 7 is an enlarged view, taken from the right side, and showing the structure of the stamping mechanism.

FIG. 7 is an enlarged view of the main parts of the stamping mechanism 72, as viewed from the right side of the printer 40, and illustrates the connection between the stud 82 of the L-shaped arm 80 and the stamp holder 86. As seen in FIG. 7, the pressing force of the spring 96 is transmitted to the stamp holder 86 through the washer 92 located at the lower end of the spring 96. It should be noted that while a pair of studs 82 and 84 and associated parts are used in the stamping mechanism (FIG. 6), the right side views of the ensuing figures show only the one stud 82.

Figure 8:
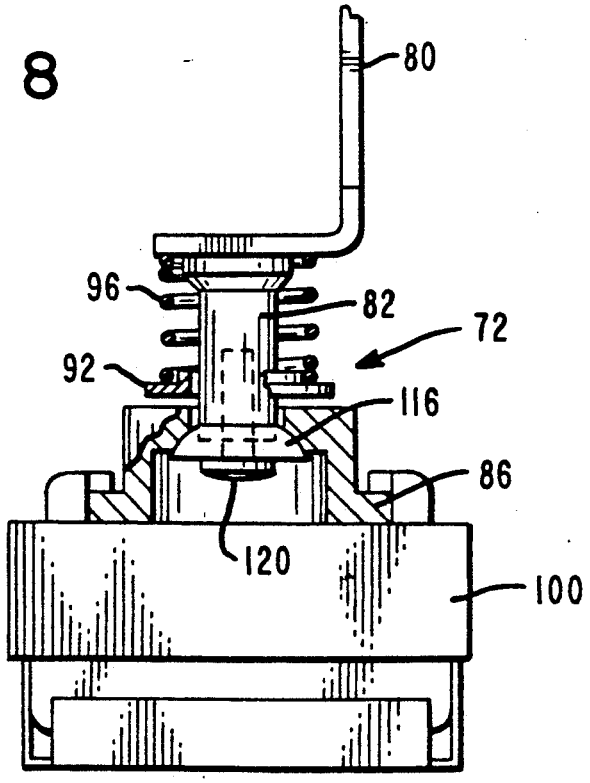
FIG. 8 is a similar view as FIG. 7 and showing the structure, partially in section, of the stamping mechanism.

FIG. 8 is a similar view as FIG. 7 and shows certain of the parts in sectional manner.

Figure 9:
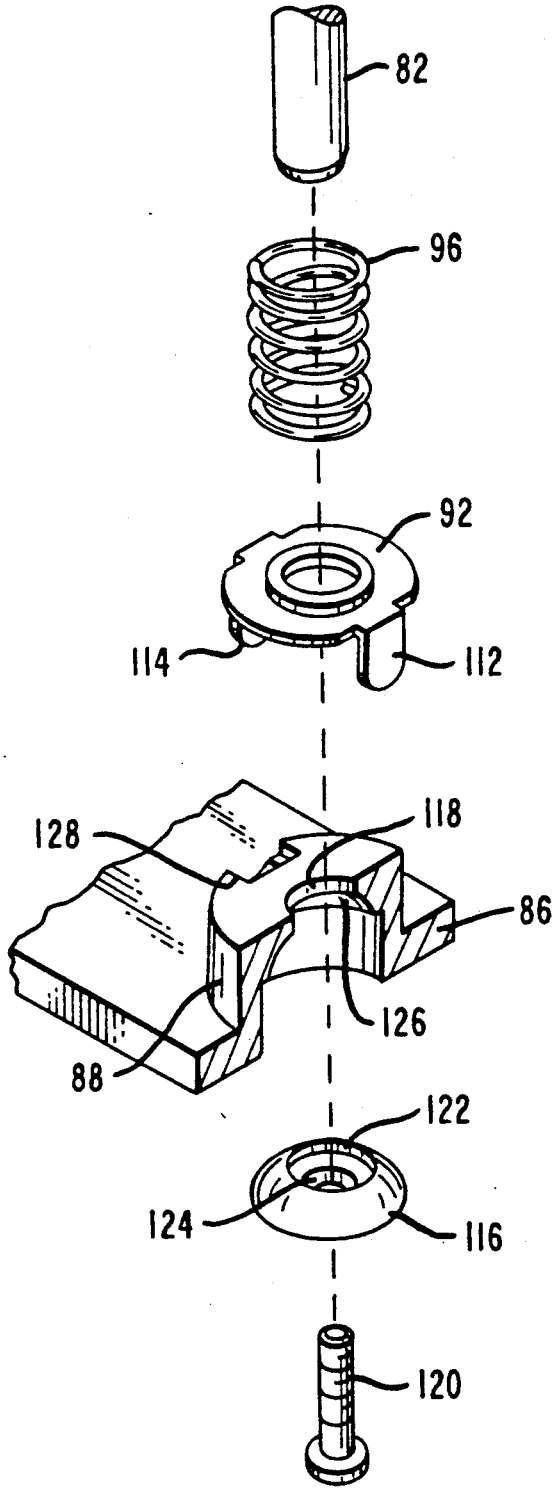
FIG. 9 is an exploded view showing certain elements of the stamping mechanism.

Referring now to FIG. 9, wherein the parts are shown in exploded manner, the stud 82 and spring 96 are disposed above the washer 92. The stamp holder 86 is shown with the cylindrical portion in sectional manner so as to better illustrate the structure of the holder. The washer 92 has a pair of tongue members, as 112 and 114, diametrically opposed and extending downwardly from the periphery of the washer 92 to engage with the stamp holder 86. The pressing force of the spring 96 is transmitted to the stamp holder 86 by means of the tongue members 112 and 114. The tongue members 112 and 114 are smaller in width than the diameter of the spring 96, so that the tongue members 112 and 114 can uniformly transmit the pressing force of the entire spring 96 to the stamp holder 86 even though there may be a difference in the pressing force between the right and left side portions of the spring 96.

Referring again to FIG. 8, the sectional view illustrates the interior portion of the stamp holder 86 and the coupling between the holder and the stud 82. The stamp holder 86 is shown being held in position by the spring 96 wherein the holder is engaged with a skirt portion 116 of the stud 82. The stamp holder 86 is provided with a hole 118 (FIG. 9) in the center of the cylindrical portion 88. The stud 82 is inserted through the hole 118 and the skirt portion 116 is secured to the lower end of the stud with a screw 120. The skirt portion 116 is shaped and formed like a hemisphere with a portion removed to provide a seat 122 to receive the lower end of the stud 82. The skirt portion also has a hole 124 therethrough for the screw 120, the screw being screwed into the lower end of the stud 82 to secure the skirt portion 116 thereto.

An inner wall 126 (FIG. 9) of the stamp holder 86 provides a contact surface for the skirt portion 116. The inner wall 126 is constructed to have a radius of curvature which is the same as that of the spherical surface of the skirt portion 116. The cylindrical portion 88 of the stamp holder 86 includes a pair of grooves, as 128 (FIG. 9) and 130 (FIG. 7), diametrically opposed and positioned to accept the tongue members 112 and 114 of the washer 92. The pressing force of the spring 96 is transmitted to the stamp holder 86 by means of the tongue members 112 and 114 engaging in the grooves 128 and 130.

Figure 10:
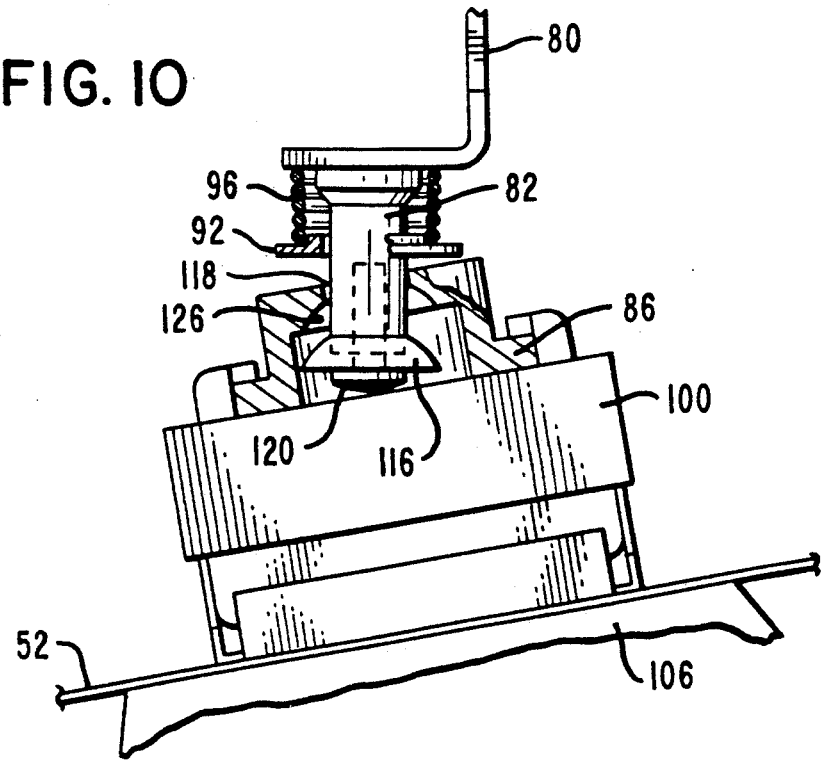
FIG. 10, on the sheet with FIG. 1, is a similar view as FIG. 8 and showing the structure in position for a stamping operation.

The operation of the preferred embodiment of the structure of the present invention is described with reference to FIGS. 6, 10, 11 and 12. When the solenoid 76 is energized, the plunger 78 is driven downwardly which moves the L-shaped arm 80, the stamp holder 86 and the stamp 100 in the same direction. When the stamp 100 reaches the position wherein it contacts the platen 106, the angle of the stamp is changed to conform with the slope of the platen. After the entire lower surface 132 of the stamp 100 has come into contact with the platen 106, only the stud 82 moves downwardly through the hole 118 of the stamp holder 86, as shown in FIG. 10. When the stud 82 is moved to such downward position, as shown in FIG. 10, the spring 96 is compressed, so that the force of depressing the stamp holder 86 via the washer 92 is increased and the message is stamped or printed on the receipt paper 52 by the increased pressing force. As noted above, the pressing force of the spring 96 is transmitted substantially uniformly to the entire surface of the stamp 100 by the tongue members 112 and 114 of the washer 92 engaging the grooves 128 and 130 of the stamp holder 86.

When the solenoid 76 is deenergized, the parts are shown as being returned to an original position, as illustrated in FIGS. 7 and 8. Referring again to FIGS. 10, 11 and 12, upon deenergization of the solenoid 76, the plunger 78 is driven in the upward direction by the spring 108 (FIG. 6) provided on the solenoid and such action carries the stud 82 also in the upward direction. When the stud 82 moves upward, the surface of the skirt portion 116 first comes into contact with the inner wall surface 126 of the stamp holder 86. Then, when the stud 82 moves further upward and the stamp 100 leaves the surface of the receipt paper 52 on the platen 106, the stamp holder 86 is pressed against the surface of the skirt portion 116 by the pressing force of the spring 96. In this respect, the stamp 100 and the stamp holder 86 are moved upwardly to their original positions, as shown in FIGS. 11 and 12, at an angle determined by the slope of the platen 106 and sustained by the frictional force between the surface of the inner wall 126 of the cylindrical portion 88 and the exterior surface of the skirt portion 116 (FIG. 12).

Figure 11:
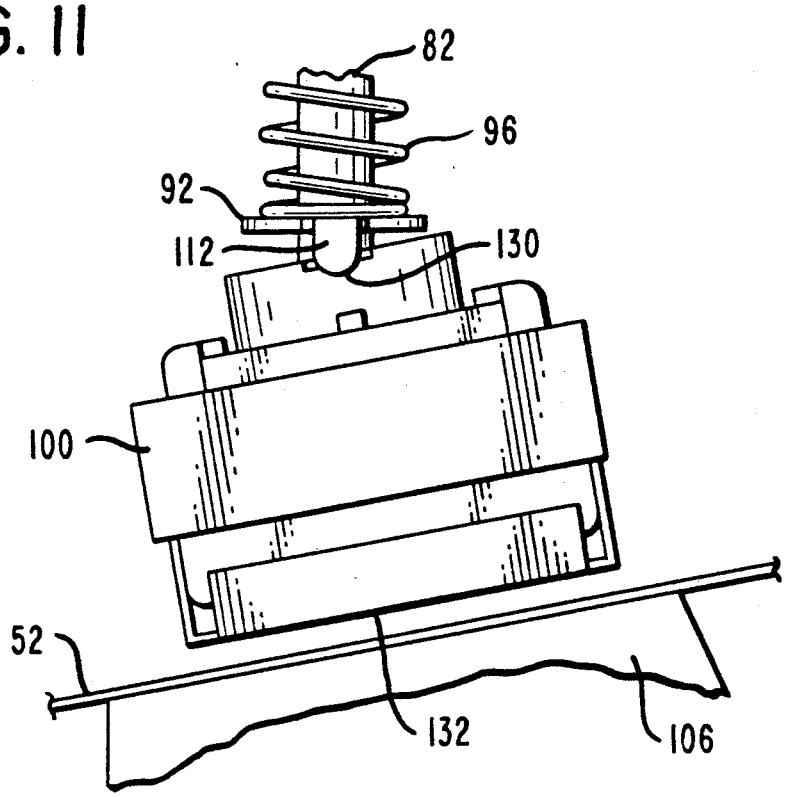
FIG. 11 is a similar view as FIG. 7 and showing the structure of the stamping mechanism in position after a stamping operation.
Figure 12:
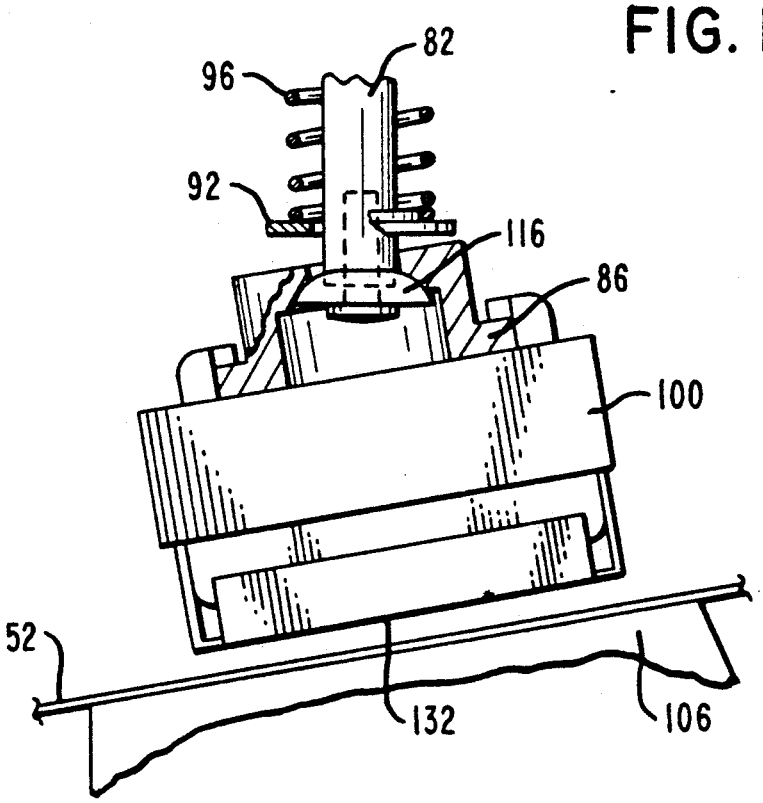
FIG. 12 is a similar view as FIG. 8 and showing the structure, partially in section, of the stamping mechanism after a stamping operation.

It should be noted in FIGS. 11 and 12 that the washer 92 and the stamp holder 86 are not in contact with each other, however, the tongue members 112 and 114 of the washer 92 are engaged and in contact with the grooves 128 and 130 of the cylindrical portion 88 of the stamp holder 86. It should be further noted that the engagement grooves 128 and 130 are provided at the center of the portion 88 in opposed manner and that the tongue members 112 and 114 and the grooves 128 and 130 are shaped in a configuration wherein, regardless of the angle of the stamp holder 86, the entire surfaces of the tongue members 112 and 114 are in contact with the grooves 128 and 130. Therefore, the pressing force of the spring 96 does not act in a directional manner for returning the stamp holder 86 to the horizontal position, as shown in FIGS. 7 and 8, but presses the surface of the inner wall 126 of the cylindrical portion 88 of the stamp holder 86 against the surface of the skirt portion 116. The stamp holder 86 and the stamp 100 are maintained in parallel relationship with the surface of the platen 106 by the frictional force generated between the of portion 88 of the stamp holder 86 and the surface of the skirt portion 116 (FIG. 12). Accordingly, once a stamping operation is performed in the manner of printing a message on the receipt paper 52, the surface of the stamp 100 is maintained parallel with the surface of the platen 106. In this regard, the entire area of the surface of the stamp 100 is uniformly pressed against the receipt paper 52 in each and every successive stamping operation.

In accordance with the stamping mechanism of the present invention, the angle of the stamp holder 86 varies with that of the platen 106 and is placed in parallel relationship therewith at the completion of the first stamping operation. The angle of the stamp holder 86 is then maintained by the pressing force of the spring 96 and the friction between the inner wall 126 of the portion 88 of the stamp holder 86 and the skirt portion 116. Additionally, when the angle of the seat face or contact surface of the spring 96 varies or does not stay true, the pressing force of the spring 96 is transmitted to the stamp holder 86 by reason of the relatively small surface areas of the tongue members 112 and 114 being in contact with the grooves 128 and 130 of the stamp holder 86, with the result that the pressing force of the entire spring 96 is uniformly transmitted to the stamp holder 86 and to the stamp 100.

To clarify how the stamp holder 86 and the stud 82, the spring 96 and the skirt portion 116 cooperate to maintain a parallel relationship after the initial operation, reference is made to FIGS. 5 and 10. When the solenoid 76 is deenergized, the stamp holder 86 moves upwardly under the force of the spring 96. As seen in FIG. 11, the force of the spring 96 operates on the tongue members 112 and 114 which fit into the grooves 128 and 130 at the center of the stamp holder 86 and thus maintain the stamp holder 86 at the angle of the platen 106.

When the stud 82 moves upwardly, the lower surface 132 of the stamp 100 remains at the angle of the stamping operation until the surface of the skirt portion 116 engages the surface of the inner wall 126 of the stamp holder 86. At this point, the stamp holder 86 is moved upwardly, as seen in FIG. 12, and the force of the spring 96 provides the friction between the surface of the skirt portion 116 and the surface of the inner wall 126 of the cylindrical portion 88 of the stamp holder 86 to maintain the parallel relationship of the parts.

It is thus seen that herein shown and described is a stamping apparatus wherein the pressing force of a spring 96 is transmitted to the center portion of a stamp holder 86 by means of a washer element 92. The washer element 92 includes tongue members 112 and 114 that engage with grooves 128 and 130 in the stamp holder 86 to transmit the pressing force in even manner. After the initial stamping operation, the entire stamping surface of the stamp 100 is uniformly pressed against the record media 52 on the platen 106 in succeeding stamping operations and effects even printing of the message on such record media.

The apparatus and arrangement enable the accomplishment of the objects and advantages mentioned above, and while the preferred embodiment of the invention has been disclosed herein, variations thereof may occur to those skilled in the art. It is contemplated that all such variations not departing from the spirit and scope of the invention hereof are to be construed in accordance with the following claims.

What is claimed is:

1. A stamping mechanism for use in a printer having a platen and record media supported on the platen, said stamping mechanism comprising a stamp, a stamp holder for holding said stamp and positioned for moving said stamp into contact with the record media on said platen, said stamp holder defining a curved cutout portion, solenoid means for moving said stamp holder from a stamp non-contact position to a stamp contact position with said record media, resilient means operably associated with said solenoid means, and means supporting said stamp holder and including a stud member coupled to said solenoid means and including a washer member encircling said stud member, said resilient means engageable with said washer member, said washer member having projecting elements engageable with said stamp holder and urged by said resilient means for pressing said stamp holder into the stamp contact position with said record media, and said stud member having a curved member secured thereto and said curved member having a surface frictionally engageable and mating with the curved cutout portion of said stamp holder and urged by said resilient means for maintaining said stamp holder in parallel relationship with said platen after an initial stamping operation.

2. The stamping mechanism of claim 1 wherein said resilient means encircles said stud member and bears against said washer member for biasing the projecting elements into engagement with said stamp holder.

3. The stamping mechanism of claim 1 wherein said projecting elements are integral with said washer member.

4. The stamping mechanism of claim 1 wherein said stamp holder defines recesses therein for receiving said projecting elements for pressing said stamp holder into the stamp contact position.

5. The stamping mechanism of claim 4 wherein said projecting elements are diametrically positioned on said washer member and said recesses in said stamp holder are positioned to receive said projecting elements.

6. The stamping mechanism of claim 4 wherein said projecting elements are tongue-shaped and are secured to the periphery of said washer element and said recesses in said stamp holder are positioned and formed to receive said tongue-shaped projecting elements.

7. The stamping mechanism of claim 1 wherein said stamp holder is channel-shaped and provides space for said curved member to be disposed in when the projecting elements engage with the stamp holder for a stamping operation.

8. In a printer having a printing station comprising a platen and a print head for printing on record media supported on said platen, the improvement comprising a stamping mechanism including a stamp holder for supporting a stamp element adjacent the record media on said platen, the stamp holder defining a curved cutout portion, actuating means for moving said stamp holder from a non-stamping position to a stamping position, resilient means operably associated with said actuating means, and means supporting said stamp holder and including an elongated member coupled to said actuating means and including a washer member on said elongated member, said resilient means being engageable with said washer member, said washer member having projecting elements integral therewith and engageable with said stamp holder and urged by said resilient means for pressing said stamp holder into the stamping position with said record media, and said elongated member having a curved member secured thereto and said curved member having a surface frictionally engageable and mating with the curved cutout portion of said stamp holder and urged by said resilient means for maintaining said stamp holder in parallel relationship with said platen after an initial stamping operation.

9. In the printer of claim 8 wherein said resilient means encircles said elongated member and bears against said washer member for urging the projecting elements into engagement with said stamp holder.

10. In the printer of claim 8 wherein said stamp holder defines recesses therein for receiving said projecting elements for moving said stamp holder into the stamping position.

11. In the printer of claim 10 wherein said projecting elements are diametrically positioned on said washer member and said recesses in said stamp holder are positioned to receive said projecting elements.

12. In the printer of claim 10 wherein the projecting elements are tongue shaped and are secured to the periphery of said washer element and said recesses in said stamp holder are positioned and formed to receive said tongue-shaped projecting elements.

* * * * *